US009964911B2

(12) United States Patent
Ochi

(10) Patent No.: US 9,964,911 B2
(45) Date of Patent: May 8, 2018

(54) DRIVING FORCE TRANSMITTING APPARATUS AND IMAGE FORMING APPARATUS

(71) Applicant: CANON KABUSHIKI KAISHA, Tokyo (JP)

(72) Inventor: Junichi Ochi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/072,199

(22) Filed: Mar. 16, 2016

(65) Prior Publication Data

US 2016/0274526 A1 Sep. 22, 2016

(30) Foreign Application Priority Data

Mar. 20, 2015 (JP) ..... 2016-021448
Feb. 8, 2016 (JP) ..... 2015-057119

(51) Int. Cl.
*G03G 15/00* (2006.01)
*G03G 21/18* (2006.01)

(52) U.S. Cl.
CPC ..... *G03G 15/757* (2013.01); *G03G 21/1864* (2013.01); *G03G 21/1853* (2013.01)

(58) Field of Classification Search
CPC ..... G03G 21/16; G03G 21/18; G03G 21/185
See application file for complete search history.

(56) References Cited

U.S. PATENT DOCUMENTS 6,473,580 B1 * 10/2002 Inomata ..... F16D 1/112 399/111
2003/0138270 A1 * 7/2003 Matsuoka ..... G03G 15/0194 399/228
2006/0216061 A1 * 9/2006 Yamaguchi ..... G03G 21/1825 399/111

FOREIGN PATENT DOCUMENTS

| | | | |
|---|---|---|---|
| JP | 2006090387 | A | 4/2006 |
| JP | 3884960 | B2 | 2/2007 |
| JP | 2009103963 | A | 5/2009 |
| JP | 2010107008 | A | 5/2010 |
| JP | 2011185293 | A | 9/2011 |
| JP | 5559379 | B2 | 7/2014 |

* cited by examiner

*Primary Examiner* — Victor Verbitsky
(74) *Attorney, Agent, or Firm* — Canon U.S.A., Inc. IP Division

(57) ABSTRACT

Included are an output member including a coupling allowed to be engaged with a unit; an input member; an input-side engagement member; an output-side engagement member allowed to be engaged with the input-side engagement member; an elastic member urging the input-side engagement member toward the output-side engagement member; and a disengagement member which moves the input-side engagement member at an engaged position, at which engagement with the output-side engagement member is allowed, to a disengaged position at which engagement with the output-side engagement member is released. In each of a state where the input-side engagement member is at the engaged position and a state where the input-side engagement member is at the disengaged position, a space is formed in which the output-side engagement member is allowed to move in the shaft direction when the output member is pressed to the shaft direction.

18 Claims, 12 Drawing Sheets

DRIVING FORCE TRANSMITTING APPARATUS AND IMAGE FORMING APPARATUS

BACKGROUND OF THE INVENTION

Field of the Invention

The present invention relates to a driving force transmitting apparatus for transmitting a driving force to a unit detachably attachable to an image forming apparatus main body, and relates to an image forming apparatus including the same.

Description of the Related Art

In recent years, image forming apparatuses such as electrophotographic printers and copying machines have been desired to have improved operability. From a viewpoint of the improvement in operability, a cartridge system in which a photosensitive member and a process unit which acts the photosensitive member, such as a charging unit, a developing unit, and a cleaning unit, are integrally assembled into a cartridge and the cartridge is detachably attachable to an image forming apparatus main body has been employed. By using this cartridge system, operability is further improved, so that it became possible to easily perform maintenance of the above-described process unit such as the developing unit by a user himself/herself.

Similarly, an intermediate transfer body or the like of the image forming apparatus main body is also constituted as a unit and the unit is detachably attachable to the image forming apparatus main body so that operability and ease of maintenance are obtained.

Further, for a driving force transmitting apparatus for stably and reliably transmitting a driving force to these units detachably attachable to the image forming apparatus main body, a coupling pair formed by combining a projected portion and a corresponding recessed portion has been used. In this case, one of the coupling pair needs to be moved to be disengaged when the unit is detached from the apparatus main body. Conventionally, a configuration has been generally used in many cases in which in association with an operation of opening a cover which opens/closes the apparatus main body the coupling on the apparatus main body side moves in a rotation shaft direction so as to be separated from the coupling on the unit side and thereby connection of the coupling pair is released.

Japanese Patent No. 5559379 discloses a configuration of a coupling mechanism which is detachably attachable without using a linking mechanism with an opening/closing cover as described above.

On the other hand, a configuration in which the number of driving motors to be used is reduced as much as possible from a viewpoint of reduction in size and cost is employed for a driving mechanism of an image forming apparatus in many cases, and in such case, outputs from the motors serving as a driving source are divided by using a gear train and the like so that a plurality of outputs are performed. When controlling the plurality of outputs so as to individually drive or stop a part of outputs of, for example, a developing unit, a transfer belt, and the like, the driving motors are difficult to be stopped. Thus, a driving force is cut off by providing a clutch mechanism in some cases.

Japanese Patent No. 3884960 discloses one example of a specific configuration of a clutch mechanism in which an output shaft is difficult to be moved in a shaft direction.

SUMMARY OF THE INVENTION

FIG. 14 illustrates a configuration of a clutch mechanism of the same type as that disclosed in Japanese Patent No. 3884690. The clutch mechanism includes a driving force input gear 101, an input-side engagement member 103 which is slidable in a shaft direction, and a spring 102 for applying an urging force to the input-side engagement member 102. The input-side engagement member 103 has an area in which it is allowed to slide in a shaft direction. The input-side engagement member 103 has protruding portions 103*a* which are engaged in grooves provided inside the driving force input gear 101, and when the protruding portions 103*a* are engaged in the grooves, the input-side engagement member 103 rotates integrally with the driving force input gear 101. The clutch mechanism includes an output shaft 104, an output-side engagement member 105 which rotates integrally with the output shaft 104, and a parallel pin 106 for fixing the output-side engagement member 105 to the output shaft 104. The clutch mechanism includes a bearing 109, engagement control members 107 and 108 for controlling an engaged state and a disengaged state by moving the input-side engagement member 103, and respectively have a cylindrical cam 107*a* and a cylindrical cam 108*a*.

For obtaining the engaged state described above, the engagement control member 108 is rotated by a lever (not illustrated) or the like to be located at a position where the cylindrical cam does not act as illustrated in FIG. 15. Then, with an elastic force of the spring 102, the input-side engagement member 103 is moved and pressed against the output-side engagement member 105 to be engaged therewith.

On the other hand, for obtaining the disengaged state described above, the engagement control member 108 is rotated by a lever (not illustrated) or the like so that the engagement control member 107 is moved in a direction away from the engagement control member 108 by action of the cylindrical cam as illustrated in FIG. 16. Then, the engagement control member 107 pushes the input-side engagement member 103 against the spring 102 to release engagement with the output-side engagement member 105.

In a clutch mechanism of the same type as the clutch mechanism disclosed in Japanese Patent No. 3884960, an output shaft is difficult to be moved in a shaft direction. Thus, the coupling mechanism movable in a shaft direction, which is disclosed in Japanese Patent No. 5559379, is difficult to be disposed on the output shaft in the clutch mechanism.

That is, the coupling mechanism disclosed in Japanese Patent No. 5559379 has a configuration in which one of the coupling pair moves in the shaft direction with an attachment/detachment operation of an attaching/detaching unit. On the other hand, in the clutch mechanism of the same type as the clutch mechanism disclosed in Japanese Patent No. 3884960, when the output shaft 104 is urged to a frame 110 side, an urging force is transmitted to the driving force input gear 101, the output-side engagement member 105, and the bearing 109 in this order, and the bearing 109 is regulated by the frame 110. Therefore, in the clutch mechanism of the same type as the clutch mechanism disclosed in Japanese Patent No. 3884960, the output shaft 104 is difficult to move in the shaft direction in both of the engaged state illustrated in FIG. 15 and the disengaged state illustrated in FIG. 16.

Accordingly, as described above, the coupling mechanism is difficult to be disposed on the shaft in the clutch mechanism of the same type as the clutch mechanism disclosed in Japanese Patent No. 3884960.

In the invention, a coupling member is allowed to move in a shaft direction with an attachment/detachment operation of a unit in both of a state where a driving force is released and a state where the driving force is transmitted.

In the invention, provided is a driving force transmitting apparatus which is engaged with a unit detachably attachable to a main body of an image forming apparatus and transmits or cuts off a driving force to the unit, including: an output member which includes a coupling allowed to be engaged with the unit and which is engaged with the unit to transmit the driving force; an input member; an input-side engagement member which is provided so as to be movable with respect to the output member in a shaft direction of the output member and rotates integrally with the input member; an output-side engagement member which is allowed to be engaged with the input-side engagement member and rotates integrally with the output member to move integrally in the shaft direction; an elastic member which is provided between the input member and the input-side engagement member and urges the input-side engagement member toward the output-side engagement member; and a disengagement member which moves the input-side engagement member at an engaged position, at which engagement with the output-side engagement member is allowed, in the shaft direction against an urging force of the elastic member to move the input-side engagement member to a disengaged position at which engagement with the output-side engagement member is released and cut off transmission of the driving force to the unit, in which in each of a state where the input-side engagement member is at the engaged position and a state where the input-side engagement member is at the disengaged position, a space is formed in which the output-side engagement member is allowed to move in the shaft direction when the output member is pressed to the shaft direction.

Further features of the present invention will become apparent from the following description of exemplary embodiments with reference to the attached drawings.

DESCRIPTION OF THE EMBODIMENTS

Some exemplary embodiments of the invention will be exemplarily described below in detail. It is to be noted that the dimensions, materials, shapes, and relative arrangements of components described in the exemplary embodiments should be properly changed depending on configurations of a mechanism to which the invention is applied and various conditions. Hence, unless otherwise particularly noted, it is not intended to limit the scope of the invention to the exemplary embodiments. Note that, in the following exemplary embodiments, "input" is intended to "input driving force" and "output" is intended to "output driving force".

Exemplary Embodiment 1

Figure 1:
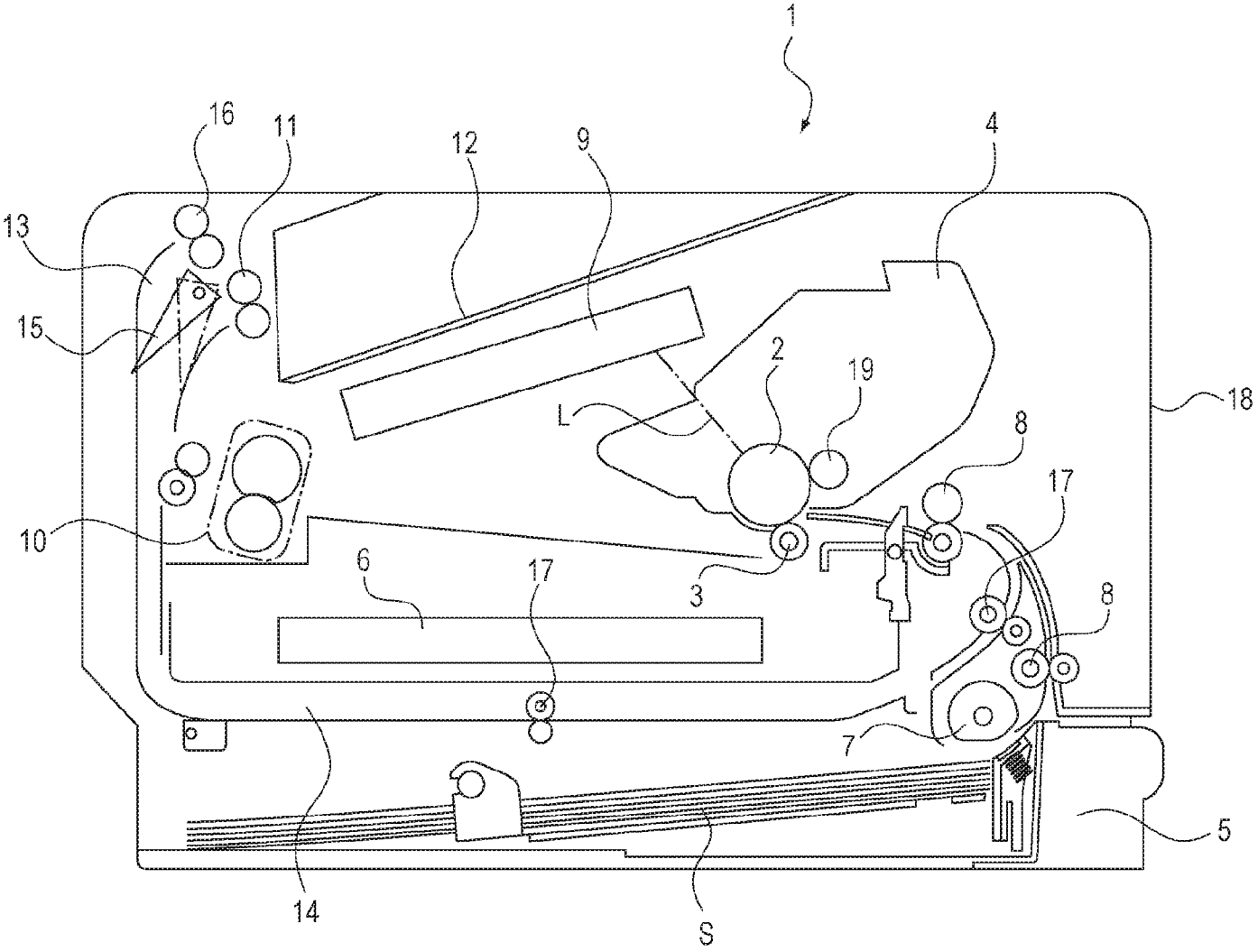
FIG. 1 is a cross-sectional view illustrating a configuration example of an image forming apparatus according to an exemplary embodiment 1 of the invention.

FIG. 1 is a cross-sectional view illustrating a configuration example of a driving force transmitting apparatus having a clutch mechanism and an image forming apparatus including the driving force transmitting apparatus according to an exemplary embodiment 1 of the invention. The clutch mechanism in the driving force transmitting apparatus will be described in detail with reference to FIG. 2 and subsequent drawings. The image forming apparatus 1 is a monochrome image forming apparatus using an electrophotographic image forming process.

As illustrated in FIG. 1, in the image forming apparatus 1, an image forming unit configured to form an image on a sheet is arranged. The image forming unit includes a photosensitive drum 2 as an "image bearing member", a developing roller 19 forming a "developing device", a transfer roller 3 as a "transfer device", and the like. In this exemplary embodiment, the photosensitive drum 2 is included in a process cartridge 4 so that a user can replace (detach or attach) the process cartridge 4 with respect to the image forming apparatus 1. Note that, in addition to the developing device (developing unit) described above, this process cartridge 4 includes, as a process unit which acts on the photosensitive drum 2, for example, a charging roller (charging unit) and a cleaning device (cleaning unit) which are not illustrated.

In the image forming apparatus 1, a feeding cassette 5 in which sheets S to be subjected to image formation are stacked is disposed. A controller (control unit) 6 controls rotation of a driving motor or driving force (not illustrated), so that a feeding roller 7 rotates to separate and feed sheets one by one, and the sheet is conveyed to a plurality of pairs of conveyance rollers 8, the photosensitive drum 2, and the transfer roller 3 in this order. An image-writing laser scanner 9 emits a laser beam L so as to form an electrostatic latent image on a surface of the photosensitive drum 2 charged by the charging roller, and a toner image is developed onto the photosensitive drum 2 by the developing device including the developing roller 19. The toner image is transferred onto a first surface of the sheet between the photosensitive drum 2 and the transfer roller 3. After that, the sheet is heated and fixed by a fixing device 10, and is conveyed onto a pair of discharge rollers 11 and a discharge tray 12 in this order.

Further, a duplex unit composed of a reverse conveyance path 13 and a duplex conveyance path 14 is arranged in the image forming apparatus 1. The reverse conveyance path 13 is provided as another route that branches between the fixing device 10 and the pair of discharge rollers 11. A path switching unit 15, which is driven by a driving source (not illustrated), is provided at the branch portion. In the reverse conveyance path 13, a pair of reverse conveyance rollers 16 which performs forward or reverse rotation for conveying the sheet reversely is provided. When performing image formation on both surfaces of the sheet, the pair of reverse conveyance rollers 16 reversely conveys the sheet that has already been subjected to image formation on the first surface, and feeds the sheet into the duplex conveyance path 14. Then, the sheet in which the first surface and a second surface are being inverted is fed into the image forming unit again by a plurality of pairs of conveyance rollers 17. The subsequent operation is performed in a similar manner to that of the first surface.

Figure 2:
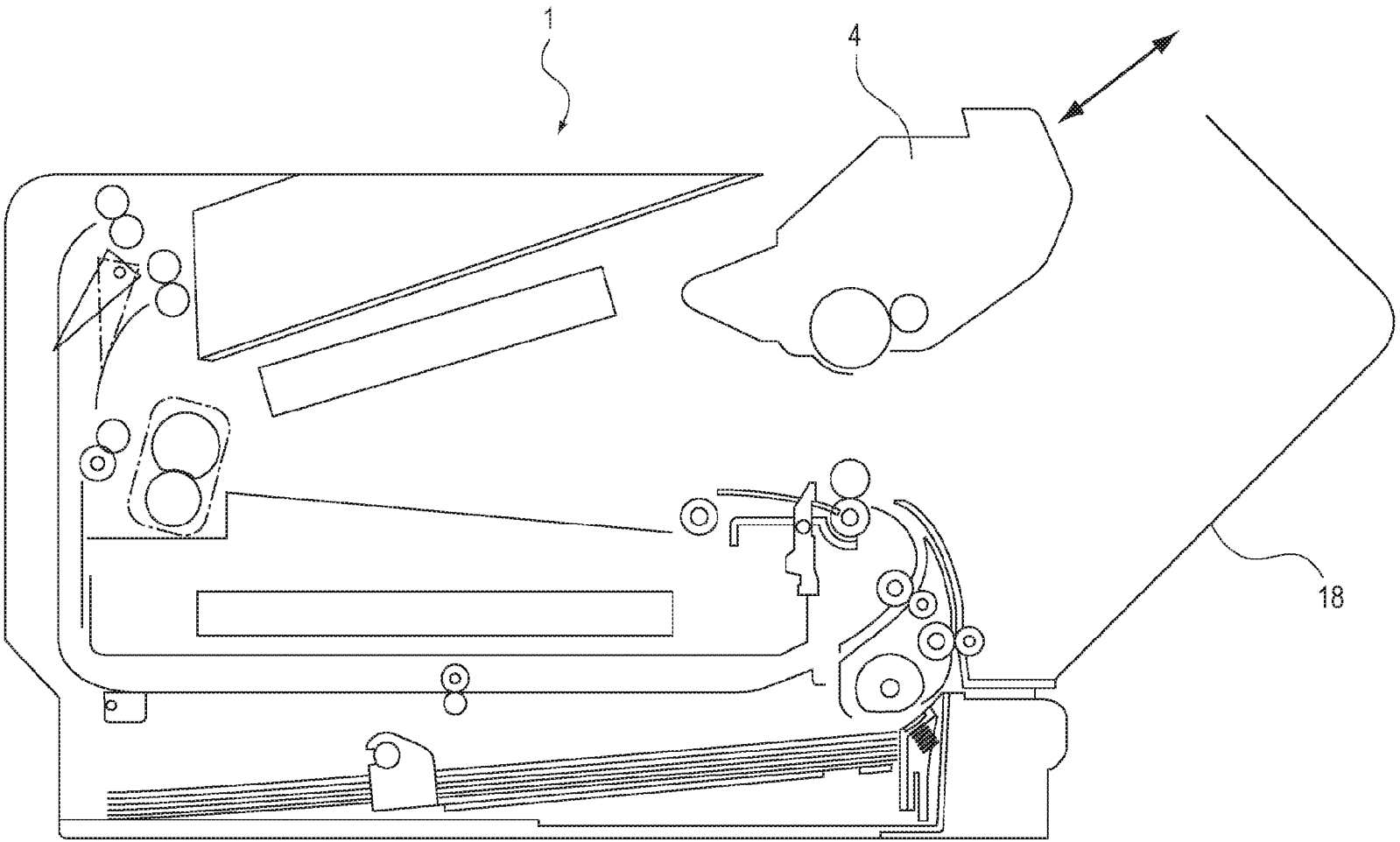
FIG. 2 is a cross-sectional view illustrating attachment and detachment of a process cartridge according to the exemplary embodiment 1 of the invention.

The user opens an openable/closable cover 18 of the image forming apparatus 1 as illustrated in FIG. 2 for replacing the process cartridge 4. A direction substantially orthogonal to a shaft direction of the photosensitive drum 2 or a driving force input shaft through which driving force is input to the process cartridge 4 serves as a removing direction and a mounting direction for the process cartridge 4.

A portion of the process cartridge 4, to which driving force is transmitted from the image forming apparatus 1, has couplings forming the driving force transmitting apparatus. Two pairs of couplings for inputting driving force to the photosensitive drum 2 and for inputting driving force to the developing roller 19 are provided in the present exemplary embodiment, but the two pairs do not necessarily have the same coupling configuration and at least one of the pairs has the configuration illustrated in the present exemplary embodiment.

Figure 3:
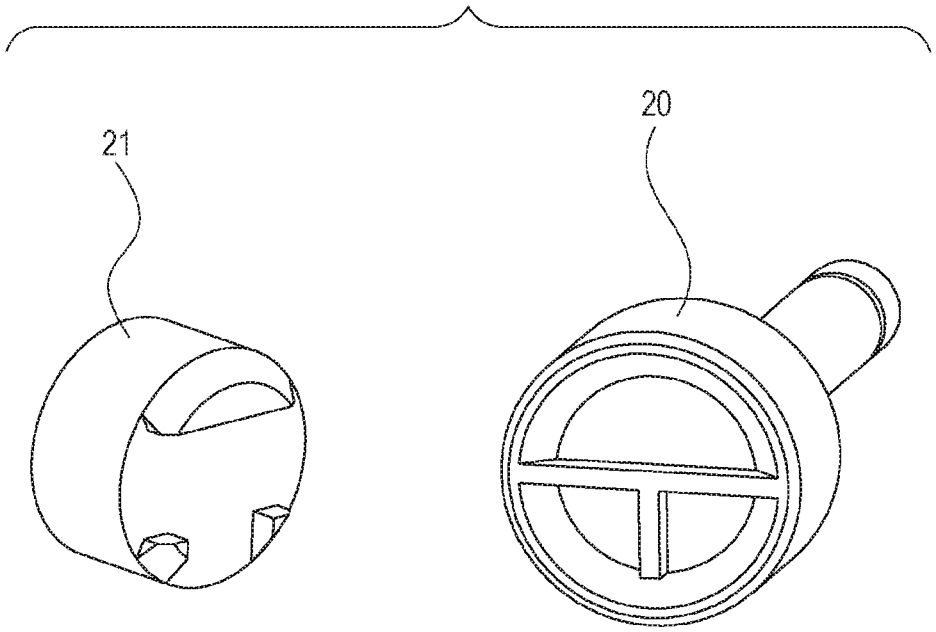
FIG. 3 is a perspective view for explaining coupling members according to exemplary embodiments 1 and 2 of the invention.

The coupling configuration in the present exemplary embodiment will be described with reference to FIG. 3. FIG. 3 illustrates shapes of the couplings in the present exemplary embodiment. The shapes illustrated in FIG. 3 are disclosed in Japanese Patent No. 5559379 as a known technique, and any shapes may be used without limitation to the shapes as long as similar effect and operation are achieved.

A pair of couplings illustrated in FIG. 3 is formed of a driving coupling 20 on an apparatus main body side and a driven coupling 21 on a process cartridge side. The driving coupling 20 is a coupling which is provided in the apparatus main body of the image forming apparatus 1 and rotates with a force of the driving source. The driving coupling 20 coaxially has a clutch member described below. The driven coupling 21 is a coupling which is provided in the process cartridge 4 serving as a unit detachably attachable to the apparatus main body and rotates being engaged with the driving coupling 20. Note that, the image forming apparatus 1 in the present exemplary embodiment has a configuration in which a single motor (driving source) drives not only the process cartridge 4 but also a feeding mechanism and the respective conveyance rollers.

Figure 4:
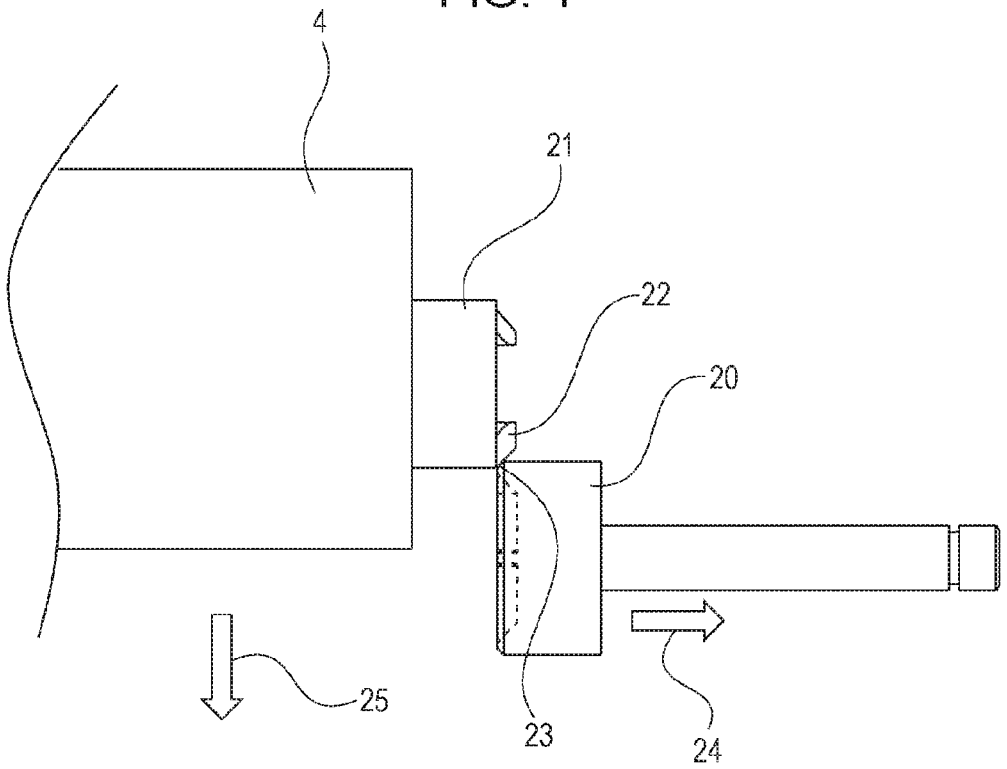
FIG. 4 is a diagram for explaining operations of the coupling members according to the exemplary embodiments 1 and 2 of the invention.

An operation of the couplings when the process cartridge 4 is attached will be described with reference to FIG. 4. FIG. 4 is a diagram of a state immediately before the couplings 20 and 21 are engaged by inserting the process cartridge 4 into the apparatus main body when viewed from a direction orthogonal to shafts of the couplings. FIG. 4 illustrates one pair of couplings by simplification for description. In the present exemplary embodiment, the process cartridge 4 is inserted in a direction indicated by an arrow 25. When the couplings 20 and 21 are engaged, a tapered surface 22 on an outer periphery of the driven coupling 21 contacts with a tapered surface 23 of the driving coupling 20, and the driving coupling 20 receives force and moves in a direction of an arrow 24 (shaft direction) substantially orthogonal to the direction of the arrow 25. Thus, the couplings 20 and 21 are allowed to be engaged. Note that, at least one of the tapered surfaces 22 and 23 at front edges (outer peripheries) of the respective couplings 20 and 21 may be, for example, a curved surface as a part of a spherical surface, or the like without limitation to an inclined surface.

Figure 5:
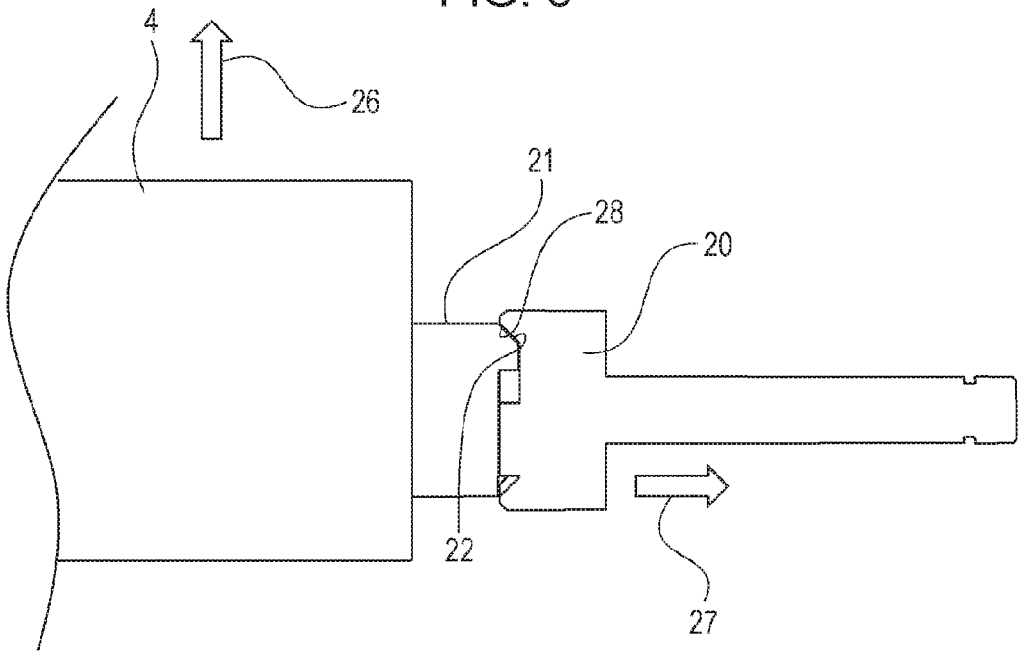
FIG. 5 is a diagram for explaining operations of the coupling members according to the exemplary embodiments 1 and 2 of the invention.

With reference to FIG. 5, an operation of the couplings when the process cartridge is detached will be described. FIG. 5 is a diagram illustrating a cross-sectional surface of the couplings 20 and 21 in the engaged state when viewed from the direction orthogonal to the shafts of the couplings 20 and 21. Note that, FIG. 5 also illustrates one pair of couplings by simplification for description similarly to FIG. 4. In the present exemplary embodiment, the process cartridge 4 is detached in a direction of an arrow 26. Then, a tapered surface 28 on an inner periphery of the driving coupling 20 contacts with the tapered surface 22 of the driven coupling 21, and the driving coupling 20 receives force and moves in a direction of an arrow 27 (shaft direction) substantially orthogonal to the direction of the arrow 26. Thus, the couplings 20 and 21 are disengaged and allowed to be separated from each other. Note that, the tapered surface 28 may be, for example, a curved surface as a part of a spherical surface, or the like without limitation to an inclined surface.

Though the front edge of the driven coupling 21 on the process cartridge side serves as a convex portion and the front edge of the driving coupling 20 on the apparatus main body side serves as a concave portion which is engaged with the convex portion, but there is no limitation thereto. In order to achieve the operation above, the shape of the driving coupling 20 may be interchanged with the shape of the driven coupling 21 so that the convex portion and the concave portion may be configured in a reversed manner. That is, the front edge of the driving coupling 20 on the apparatus main body side may serve as the convex portion and the front edge of the driven coupling 21 on the process cartridge side may serve as the concave portion which is engaged with the convex portion.

Next, a clutch mechanism in the driving force transmitting apparatus, which is a characteristic configuration of the invention, will be described in detail.

In the present exemplary embodiment, the clutch mechanism is provided in the image forming apparatus 1 coaxially with the driving coupling 20 which transmits driving force to the developing roller 19. Providing the clutch mechanism allows a driving force to be cut off during a time when rotation is unnecessary. This makes it possible to prevent various developing devices including toner which is developer contained in the process cartridge 4 and a developing roller from being degraded due to image formation processes. Note that, the similar clutch mechanism may be provided on a shaft of a coupling of the photosensitive drum 2 or may be provided in the process cartridge 4.

Figure 6:
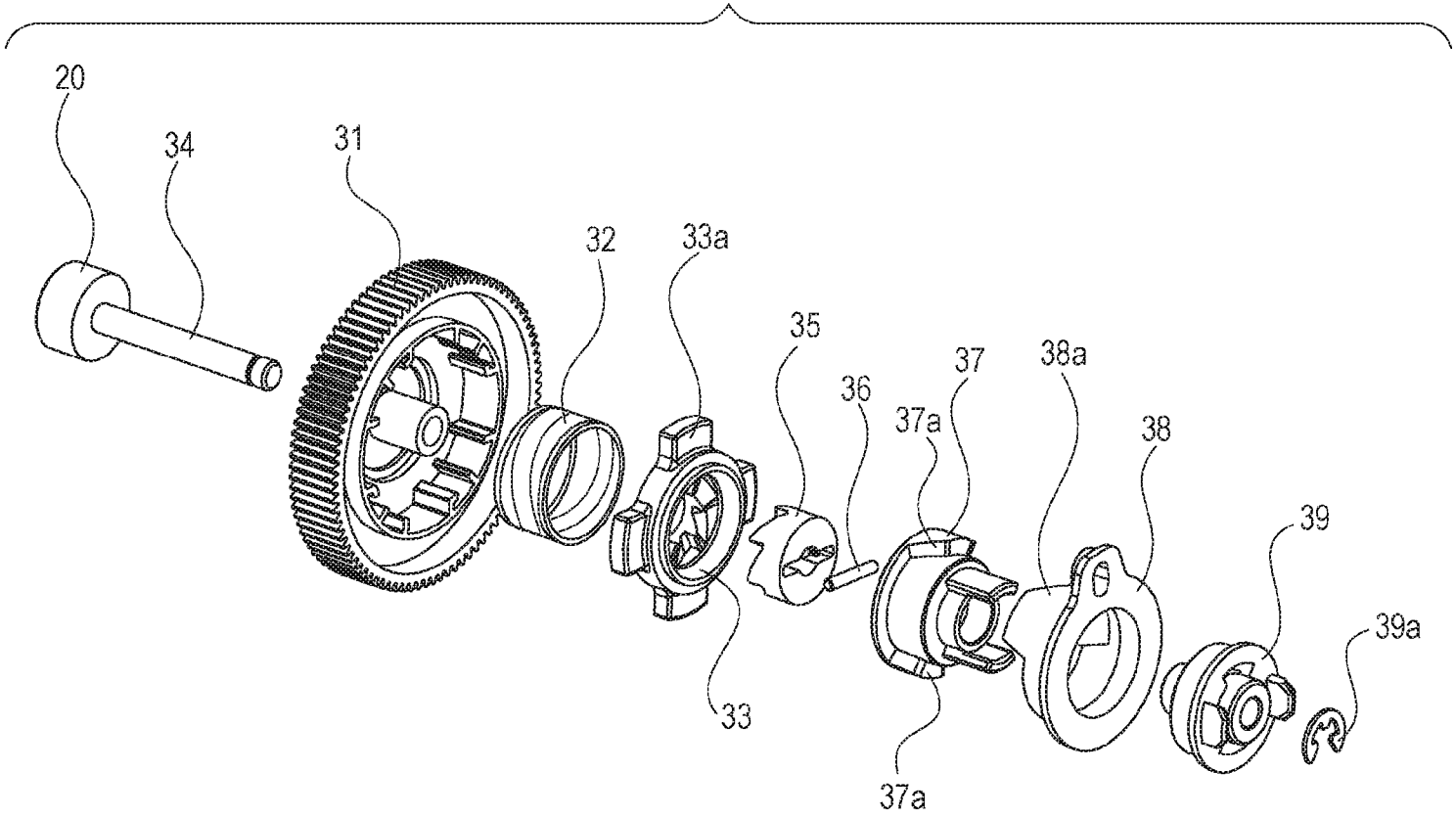
FIG. 6 is a perspective view for explaining a configuration of a clutch mechanism according to the exemplary embodiments 1 and 2 of the invention.

FIG. 6 illustrates the clutch mechanism in the present exemplary embodiment. The clutch mechanism has a driving force input gear 31, a spring 32, an input-side engagement member 33, an output shaft 34, an output-side engagement member 35, a parallel pin 36, engagement control members 37 and 38, and a bearing 39. The driving force input gear 31 is an input member. The input-side engagement member 33 is movable in a shaft direction. The spring 32 is a compression spring as an elastic member which applies an urging force to the input-side engagement member 33. The input-side engagement member 33 has protruding portions 33*a* which are engaged in grooves provided inside the driving force input gear 31. When the protruding portions 33*a* are engaged in the grooves of the driving force input gear 31, the input-side engagement member 33 rotates integrally with the driving force input gear 31. The input-side engagement member 33 also has an area in which movement in a shaft direction is allowed. Since the spring 32 also rotates integrally with the driving force input gear 31, a spring end does not rotationally slide. The output shaft 34 is an output member and has the driving coupling 20 which is engaged with the driven coupling 21 (refer to FIG. 3) on the process cartridge side at one end thereof. An e-ring 39*a* as a retaining member is attached to the other end of the output shaft 34 so that the output shaft 34 and the e-ring 39*a* are integrated in the shaft direction. The output-side engagement member 35 rotates integrally with the output shaft 34. The output-side engagement member 35 is fixed to the output shaft 34 with the parallel pin 36. This provides a configuration in which the output shaft 34 and the output-side engagement member 35 are integrated in the shaft direction so as to rotate integrally around the shaft of the output shaft 34. The bearing 39 is a bearing member, and supports the engagement control member 37 to be movable in the shaft direction with rotation thereof regulated, supports the engagement control member 38 so as to be rotatable, and supports the output shaft 34 so as to be rotatable and movable in the shaft direction with respect to a frame member 40 of the main body of the image forming apparatus 1. The engagement control member 37 and the engagement control member 38 are disengagement members configured to control (switch) an engaged state where the input-side engagement member 33 is moved in the shaft direction to be engaged with the output-side engagement member 35 and a disengaged state where the engagement is released, and respectively have a cylindrical cam 37*a* and a cylindrical cam 38*a*.

The engaged state and the disengaged state of the input-side engagement member 33 and the output-side engagement member 35 by the engagement control members 37 and 38 are described.

Figure 7:
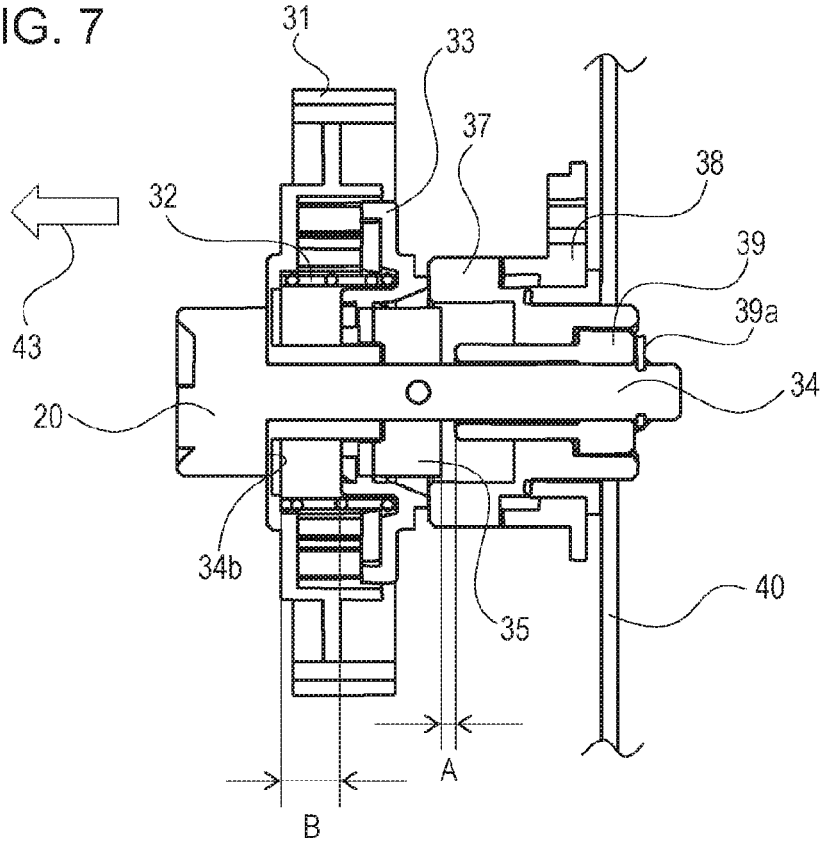
FIG. 7 is a cross-sectional view for explaining an engaged state of the clutch mechanism according to the exemplary embodiments 1 and 2 of the invention.

First, the engaged state will be described with reference to FIG. 7. FIG. 7 is a cross-sectional view of the engaged state. The frame member 40 is a member holding the clutch mechanism. In a case of performing engagement, the engagement control member 38 is rotated by a lever (not illustrated) or the like to be at a position where the cylindrical cams 37*a* and 38*a* do not act. Then, the input-side engagement member 33 which is urged toward one side of the shaft direction with an elastic force of the spring 32 is moved in the one side of the shaft direction and pressed against the output-side engagement member 35 to be engaged therewith. At this time, the driving force input gear 31 is urged toward the other side of the shaft direction with the elastic force of the spring 32 and is abutted against a contact surface 34*b* of the output shaft 34. In this case, the input-side engagement member 33 is at an engaged position at which engagement with the output-side engagement member 35 is allowed.

In the engaged state, as illustrated in FIG. 7, the engagement control member 37 contacts with the input-side engagement member 33, and a space A in which movement of the output shaft 34 in the shaft direction is allowed is provided between the output-side engagement member 35 and the bearing 39. That is, when the engagement control member 37 contacts with the input-side engagement member 33, the driving force input gear 31 presses the contact surface 34*b* with the urging force of the spring 32 to press the output shaft 34 in a direction of an arrow 43. The e-ring 39*a* is then abutted against the bearing 39 in the shaft direction. Thereby, the position of the output shaft 34 in the shaft direction is decided with the space A in which movement of the output shaft 34 in the shaft direction is allowed provided between the output-side engagement member 35 and the bearing 39. Note that, it may not be necessarily configured such that the output shaft 34 is pressed in the direction of the arrow 43 with the urging force of the spring 32. That is, it may be configured such that the engagement control member 37 does not contact with the input-side engagement member 33 and the output shaft 34 is pressed in the direction of the arrow 43 by an urging member different from the spring 32 in the engaged state of the input-side engagement member 33 and the output-side engagement member 35.

In the space A, the output-side engagement member 35 is allowed to move in the shaft direction, which is a direction away from the input-side engagement member 33, and the output-side engagement member 35 is allowed to move in the shaft direction, resulting that the output shaft 34 is allowed to move in the shaft direction. Further, a space B which is different from the space A and which allows movement of the output shaft 34 in the shaft direction is provided between the input-side engagement member 33 and the driving force input gear 31. In the space B, the driving force input gear 31 is allowed to move in the shaft direction, which is a direction in which the driving force input gear 31 moves to the input-side engagement member 33, and the driving force input gear 31 is allowed to move in the shaft direction, resulting that the output shaft 34 is allowed to move in the shaft direction.

Figure 8:
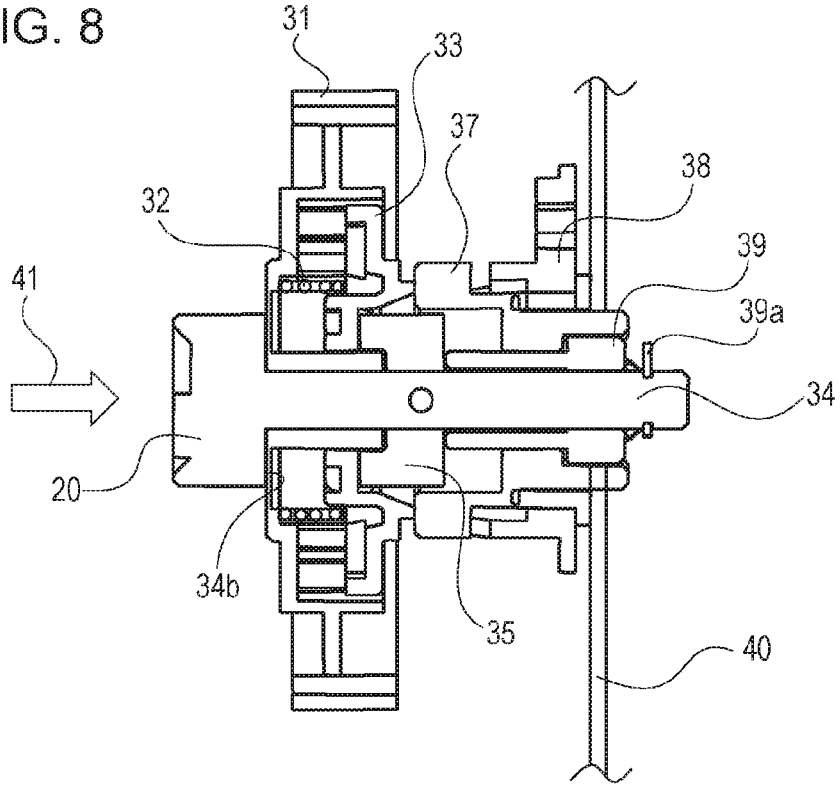
FIG. 8 is a cross-sectional view for explaining movement of an output shaft in the engaged state of the clutch mechanism according to the exemplary embodiments 1 and 2 of the invention.

FIG. 8 illustrates an operation when an attaching/detaching operation of the process cartridge is performed in a direction (direction of the arrow 25 of FIG. 4) substantially orthogonal to a drive shaft in the engaged state above. As described above, by the attaching/detaching operation of the process cartridge, the driving coupling 20 on the apparatus main body side is pressed by a predetermined amount against the frame member 40 (direction of an arrow 41) by the driven coupling 21 on the process cartridge side. Thereby, the output shaft 34 is pressed to the aforementioned one side (direction of the arrow 41) in the shaft direction, and both of the driving force input gear 31 which is pressed by the contact surface 34*b* and the output-side engagement member 35 which is fixed to the output shaft 34 by the parallel pin 36 move in the direction of the arrow 41. The driving force input gear 31 moves in the direction of the arrow 41 against the urging force of the spring 32. On the other hand, the input-side engagement member 33 which contacts with the engagement control member 37 does not move and the spring 32 existing between the driving force input gear 31 and the input-side engagement member 33 is compressed. Here, as illustrated in FIG. 7, the space A in which movement of the output shaft 34 in the shaft direction is allowed is provided between the output-side engagement member 35 and the bearing 39 in the present configuration, so that the output shaft 34 is movable in the shaft direction within a range of the space A.

When pressing of the driving coupling 20 on the apparatus main body side in the direction of the arrow 41 by the driven coupling 21 on the process cartridge side is released, with the urging force of the spring 32, the driving force input gear 31 presses the contact surface 34*b* to press the output shaft 34 in the direction of the arrow 43 (FIG. 7). The e-ring 39*a* is then abutted against the bearing 39 in the shaft direction so that the clutch mechanism returns to the original state.

Moreover, by employing the configuration above, as the urging force for returning to the original state against the movement of the output shaft 34, the spring 32 which urges the input-side engagement member 33 is able to be used, and the operation above is able to be realized without further adding an urging member. Note that, it may be configured such that the output shaft 34 is pressed in the direction of the arrow 43 (FIG. 7) by another urging member. Even with such a configuration, the urging force of the spring 32 is able to be used as the urging force for returning to the original state, so that the urging force of the other urging member is able to be reduced accordingly compared to a case where any urging force of the spring 32 is not used. Further, since the spring 32 is incorporated in the clutch mechanism, it is advantageous that there is no portion which rotationally slides with other members in terms of abnormal sounds and abrasion. After performing the attaching/detaching operation of the process cartridge, the output shaft 34 is urged and moved in a direction opposite to the aforementioned one side of the shaft direction with the urging force of the spring 32 so as to have a positional relationship illustrated in FIG. 7.

Figure 9:
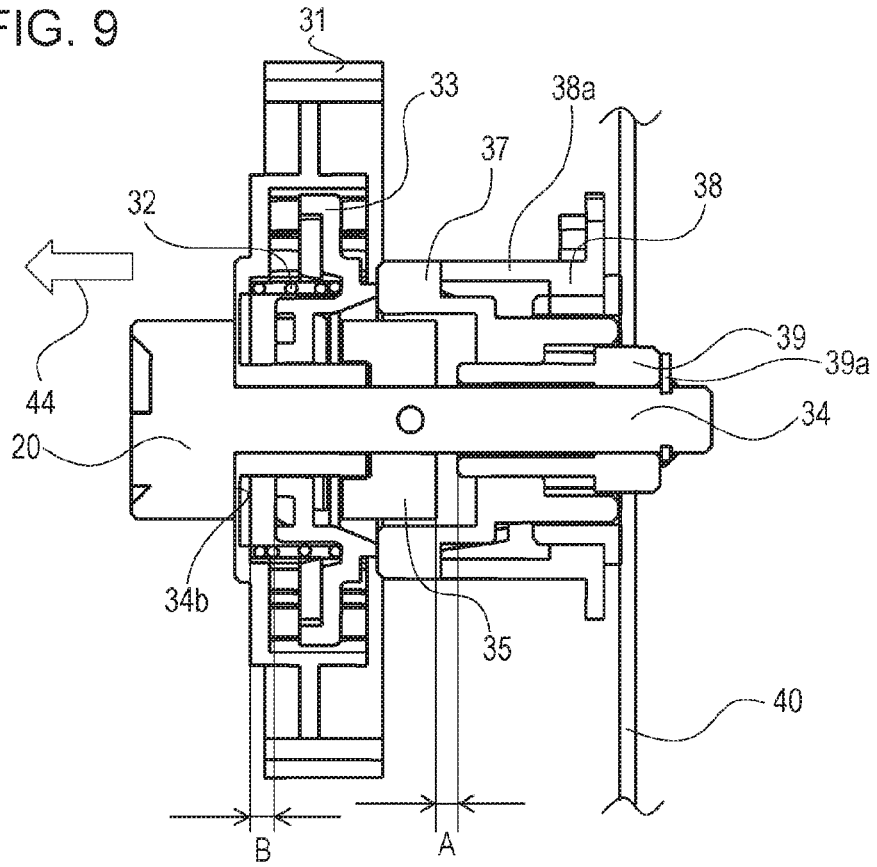
FIG. 9 is a cross-sectional view for explaining a disengaged state of the clutch mechanism according to the exemplary embodiments 1 and 2 of the invention.

Next, the disengaged state will be described with reference to FIG. 9. FIG. 9 is a cross-sectional view of the disengaged state. In a case of performing disengagement, the engagement control member 38 is rotated by a lever (not illustrated) or the like, and the engagement control member 37 is moved to the driving force input gear 31 side by acting on the cylindrical cam 37*a* with the cylindrical cam 38*a* of the engagement control member 38. Then, the engagement control member 37 moves the input-side engagement member 33 to the other side in the shaft direction, resulting that the input-side engagement member 33 is separated from the output-side engagement member 35 to be disengaged. At this time, the input-side engagement member 33 is at the disengaged position. In this case, the spring 32 is compressed between the input-side engagement member 33 and the driving force input gear 31 according to the movement of the input-side engagement member 33. That is, the engagement control member 37 moves the input-side engagement member 33 from the engaged position to the disengaged position against the urging force of the spring (by compressing the spring 32).

In the disengaged state, as illustrated in FIG. 9, the engagement control member 37 contacts with the input-side engagement member 33, and a space A in which movement of the output shaft 34 in the shaft direction is allowed is provided between the output-side engagement member 35 and the bearing 39. That is, when the engagement control member 37 contacts with the input-side engagement member 33, the driving force input gear 31 presses the contact surface 34*b* with the urging force of the spring 32 to press the output shaft 34 in a direction of an arrow 44. The e-ring 39*a* is then abutted against the bearing 39 in the shaft direction. Thereby, the position of the output shaft 34 in the shaft direction is decided with the space A in which movement of the output shaft 34 in the shaft direction is allowed provided between the output-side engagement member 35 and the bearing 39.

Further, a space B which is different from the space A and which allows movement of the output shaft 34 in the shaft direction is provided between the input-side engagement member 33 and the driving force input gear 31. In the space B, the driving force input gear 31 is allowed to move in the shaft direction, which is a direction in which the driving force input gear 31 moves to the input-side engagement member 33, and the driving force input gear 31 is allowed to move in the shaft direction, resulting that the output shaft 34 is allowed to move in the shaft direction.

Figure 10:
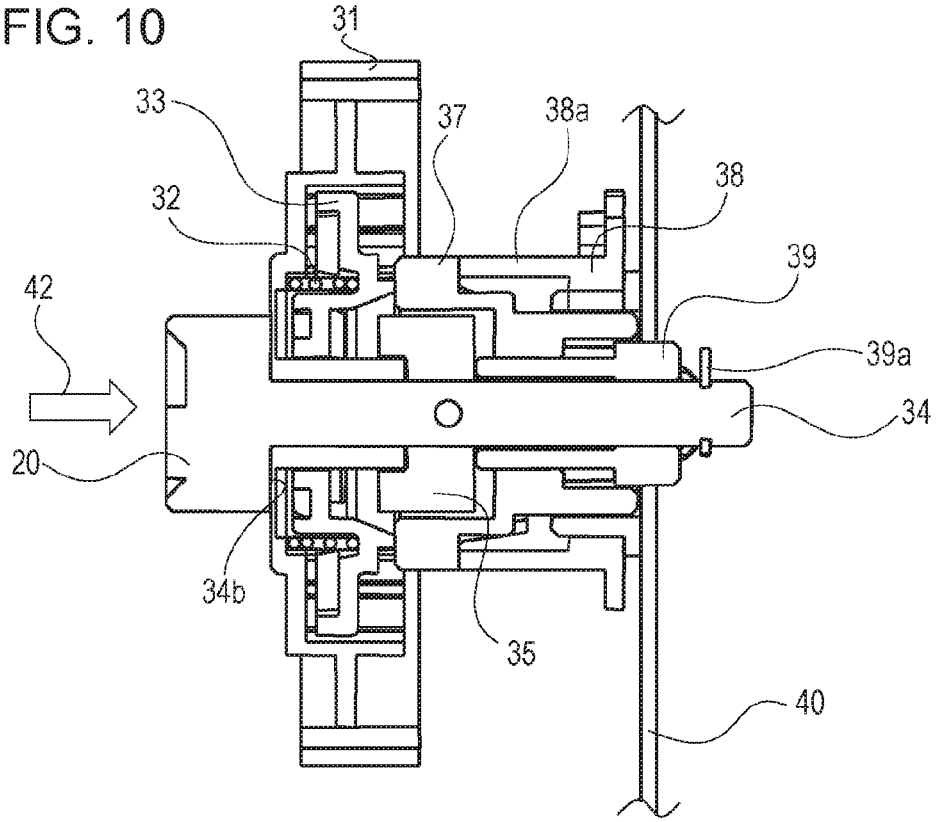
FIG. 10 is a cross-sectional view for explaining movement of the output shaft in the disengaged state of the clutch mechanism according to the exemplary embodiments 1 and 2 of the invention.

FIG. 10 illustrates an operation when an attaching/detaching operation of the process cartridge is performed in a direction (direction of the arrow 25 of FIG. 4) substantially orthogonal to a drive shaft in the disengaged state above. As described above, by the attaching/detaching operation of the process cartridge, the driving coupling 20 on the apparatus main body side is pressed by a predetermined amount to the frame member 40 side (direction of an arrow 42) by the driven coupling 21 on the process cartridge side. Thereby, the output shaft 34 is pressed to the aforementioned one side (direction of the arrow 42) in the shaft direction, and both of the driving force input gear 31 which is pressed by the contact surface 34*b* and the output-side engagement member 35 which is fixed to the output shaft 34 by the parallel pin 36 move in the direction of the arrow 42. The driving force input gear 31 moves in the direction of the arrow 42 against the urging force of the spring 32. On the other hand, the input-side engagement member 33 which contacts with the engagement control member 37 does not move and the spring 32 existing between the driving force input gear 31 and the input-side engagement member 33 is further compressed. Here, as illustrated in FIG. 9, the spaces A and B in which movement of the output shaft 34 in the shaft direction is allowed are respectively provided between the output-side engagement member 35 and the bearing 39 and between the driving force input gear 31 and the input-side engagement member 33 in the present configuration. Therefore, the output shaft 34 is allowed to move in the shaft direction within a range of the space A and the space B.

When pressing of the driving coupling 20 on the apparatus main body side in the direction of the arrow 42 by the driven coupling 21 on the process cartridge side is released, with the urging force of the spring 32, the driving force input gear 31 presses the contact surface 34*b* to press the output shaft 34 in the direction of the arrow (FIG. 9). The e-ring 39*a* is then abutted against the bearing 39 in the shaft direction so that the clutch mechanism returns to the original state.

Moreover, by employing the configuration above, as the urging force for returning to the original state against the movement of the output shaft 34, the spring 32 which urges the input-side engagement member 33 is able to be used, and the operation above is able to be realized without further adding an urging member. Note that, it may be configured such that the output shaft 34 is pressed in the direction of the arrow 44 (FIG. 9) by another urging member. Even with such a configuration, the urging force of the spring 32 is able to be used as the urging force for returning to the original state, so that the urging force of the other urging member is able to be reduced accordingly compared to a case where any urging force of the spring 32 is not used. Further, since the spring 32 is incorporated in the clutch mechanism, it is advantageous that there is no portion which rotationally slides with other members in terms of abnormal sounds and abrasion. After performing the attaching/detaching operation of the process cartridge, the output shaft 34 is urged and moved in a direction opposite to the aforementioned one side of the shaft direction with the urging force of the spring 32 so as to have a positional relationship illustrated in FIG. 9.

The process cartridge is replaced at a time when an image forming operation is not performed. In the present example, control is performed so that the aforementioned clutch (engagement between engagement members 33 and 35) is disengaged to release driving force to the developing unit at a time when the image forming operation ends. Thus, the process cartridge is replaced normally in a state where the clutch (engagement between engagement members 33 and 35) is disengaged.

However, for some reasons such as cutting off of power supply, the image forming apparatus 1 may stop in a state where the clutch (engagement between engagement members 33 and 35) is engaged, and the process cartridge may be attached/detached. In the present example, with the configuration above, movement of the output shaft 34 in the shaft direction is allowed even in the state where the clutch (engagement between engagement members 33 and 35) is engaged, so that the process cartridge is attachable/detachable.

As described above, according to the present exemplary embodiment, in both of a state where a driving force is released and a state where the driving force is transmitted, movement of the output shaft 34 in the shaft direction is allowed, so that the couplings are able to be moved in the shaft direction by the attaching/detaching operation of the process cartridge.

Exemplary Embodiment 2

Figure 11:
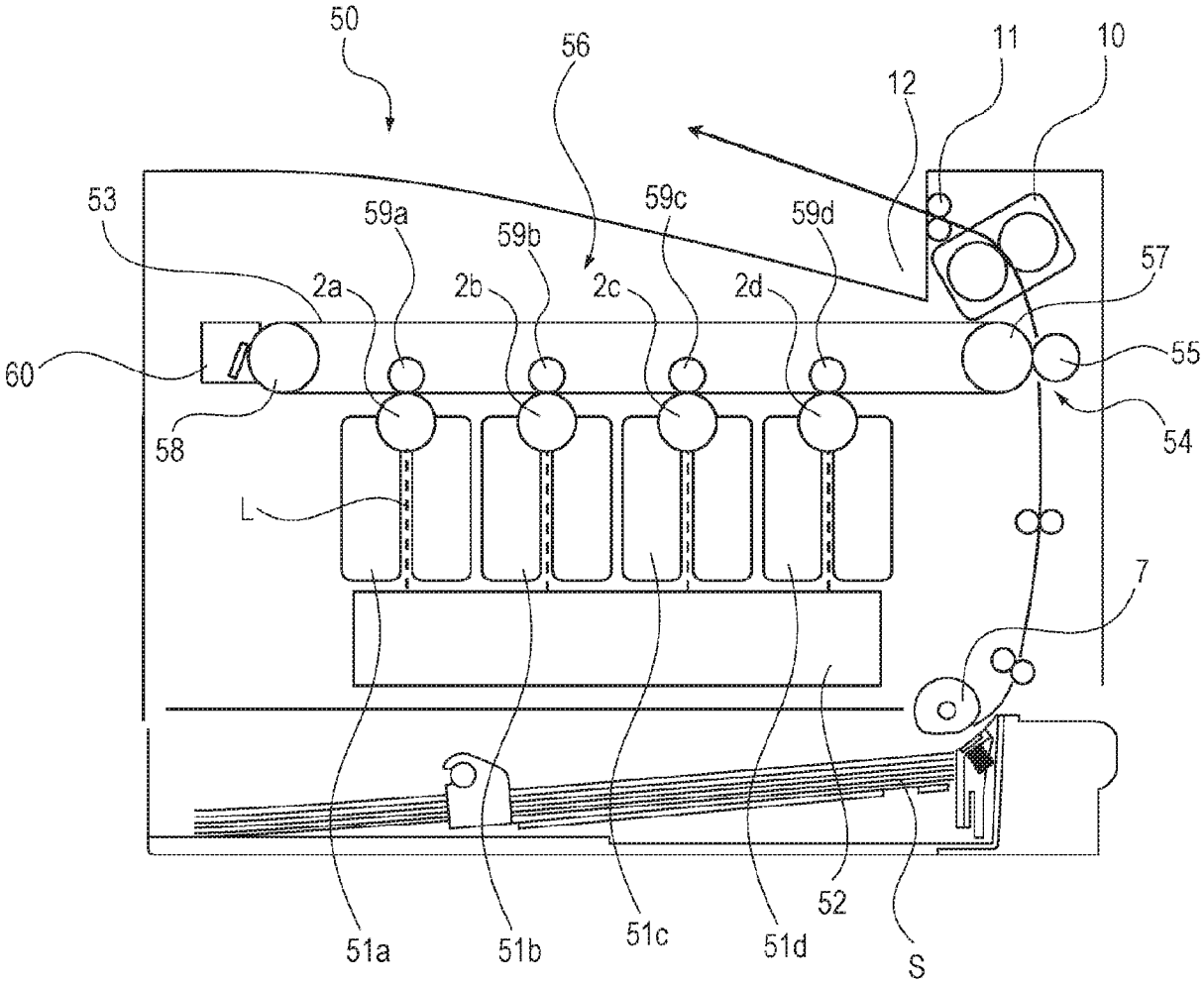
FIG. 11 is a cross-sectional view illustrating a configuration example of an image forming apparatus according to an exemplary embodiment 2 of the invention.

FIG. 11 is a cross-sectional view illustrating a configuration example of a driving force transmitting apparatus having a clutch mechanism and an image forming apparatus including the same according to an exemplary embodiment 2 of the invention. The clutch mechanism in the driving force transmitting apparatus is the same as one described in the exemplary embodiment 1. The same components and effects as those of the exemplary embodiment 1 are described by using the same reference signs to omit description thereof as appropriate.

An image forming apparatus 50 according to the present exemplary embodiment is an in-line color image forming apparatus using an electrophotographic image forming process. As illustrated in FIG. 11, four process cartridges configured to perform image formation are provided inside the image forming apparatus 50. The respective process cartridges include photosensitive drums 2*a*, 2*b*, 2*c*, and 2*d* serving as "image bearing members", developing rollers (not illustrated), charging rollers (not illustrated), cleaning devices (not illustrated), and the like. The respective process cartridges are configured to be replaceable (detachably attachable) by a user with respect to an apparatus main body of the image forming apparatus 50. These four process cartridges 51*a*, 51*b*, 51*c*, and 51*d* are the same in the structure, but are different in terms of forming images of different colors by using toner of yellow (Y), magenta (M), cyan (C), and black (Bk).

An image-writing laser scanner 52 emits four laser beams L so as to form electrostatic latent images on surfaces of the photosensitive drums 2*a*, 2*b*, 2*c*, and 2*d* charged by the charging rollers (not illustrated). Toner is supplied to the electrostatic latent images and toner images of Y, M, C, and Bk are formed on the surfaces of the photosensitive drums 2*a*, 2*b*, 2*c*, and 2*d*. The toner images formed on the surfaces of the photosensitive drums 2*a*, 2*b*, 2*c*, and 2*d* are sequentially subjected to primary transfer onto a surface of an intermediate transfer belt 53. An intermediate transfer unit 56 is mainly formed of the intermediate transfer belt 53 serving as an intermediate transfer body, a driving roller 57, a driven roller 58, four primary transfer rollers 59*a*, 59*b*, 59*c*, and 59*d* serving as a primary transfer unit, a cleaning unit 60, and a primary transfer separation unit illustrated in FIG. 13. The intermediate transfer belt 53 is stretched around the driving roller 57 and the driven roller 58. The driven roller 58 is urged by an urging unit (not illustrated) to apply a predetermined tension to the intermediate transfer belt 53. The primary transfer rollers 59*a*, 59*b*, 59*c*, and 59*d* are respectively disposed inside the intermediate transfer belt 53 so as to oppose the photosensitive drums 2*a*, 2*b*, 2*c*, and 2*d* and are urged toward the respective photosensitive drums 2 by an urging member which is not illustrated.

Transfer of the toner images onto a sheet S is performed at a secondary transfer unit 54 to which the sheet S has been conveyed by a feeding roller 7. The intermediate transfer belt 53 included in the intermediate transfer unit 56 carries the toner images formed by a primary transfer process and conveys them to the secondary transfer unit 54. A bias is applied to the secondary transfer unit 55 at the secondary transfer unit 54 and the toner images on the intermediate transfer belt 53 are transferred onto the sheet S which has been conveyed. A fixing device 10 is located on a downstream side of the secondary transfer unit 54 and fixes the toner images, which have been transferred onto the sheet S, on the sheet S. The sheet on which the images are fixed is conveyed to a pair of discharge rollers 11 and a discharge tray 12 in this order.

Figure 12:
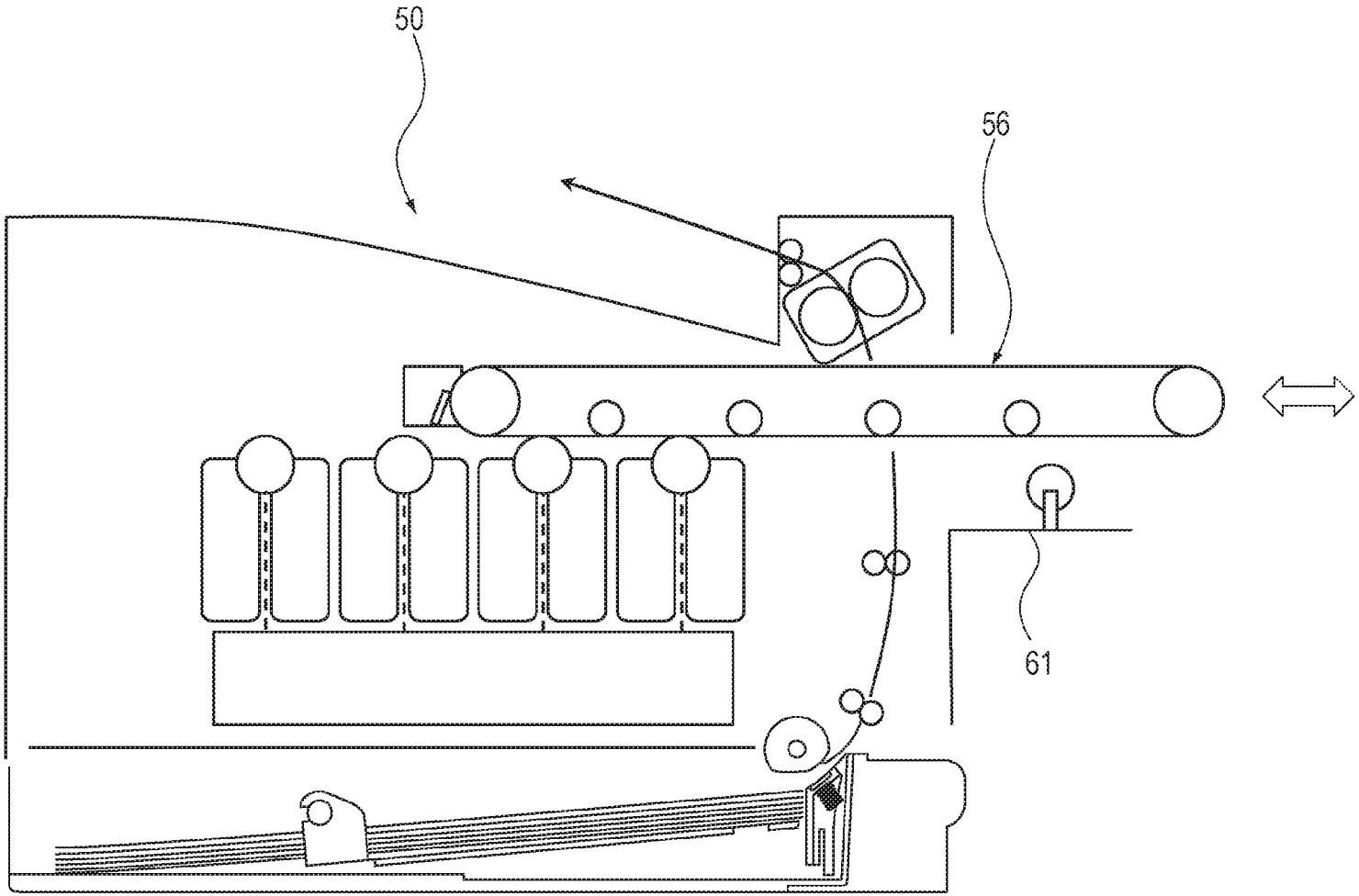
FIG. 12 is a cross-sectional view illustrating attachment and detachment of an intermediate transfer unit according to the exemplary embodiment 2 of the invention.

In the present exemplary embodiment, the intermediate transfer unit 56 is a unit detachably attachable to the apparatus main body of the image forming apparatus 50. As illustrated in FIG. 12, the intermediate transfer unit 56 is configured so as to be detachably attachable to the apparatus main body in a direction indicated by an arrow by opening an openable/closable member 61 of the apparatus main body. A direction substantially orthogonal to a shaft direction of each of the photosensitive drums 2 or a driving force input shaft through which driving force is input to the intermediate transfer unit 56 serves a removing direction and a mounting direction of the intermediate transfer unit 56.

The intermediate transfer unit 56 has a separation unit for the primary transfer rollers, corresponding to Y, M, and C, which respectively oppose the photosensitive drums 2*a*, 2*b*, and 2*c* through the intermediate transfer belt 53 during color image formation. The separation unit is used for suppressing sliding on the photosensitive drums which are not used during monochromatic image formation and for prolonging the lifetime of the photosensitive drums.

Figure 13:
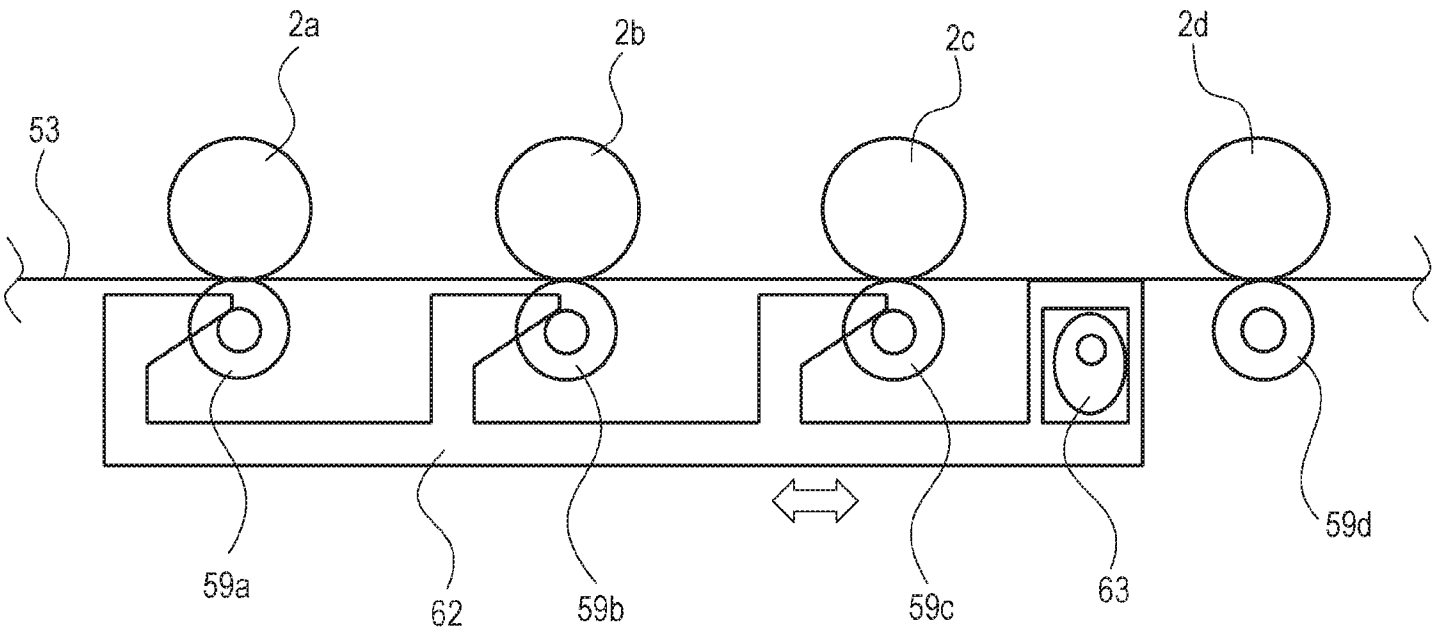
FIG. 13 is a cross-sectional view illustrating a separation mechanism of a primary transfer roller according to the exemplary embodiment 2 of the invention.
Figure 14:
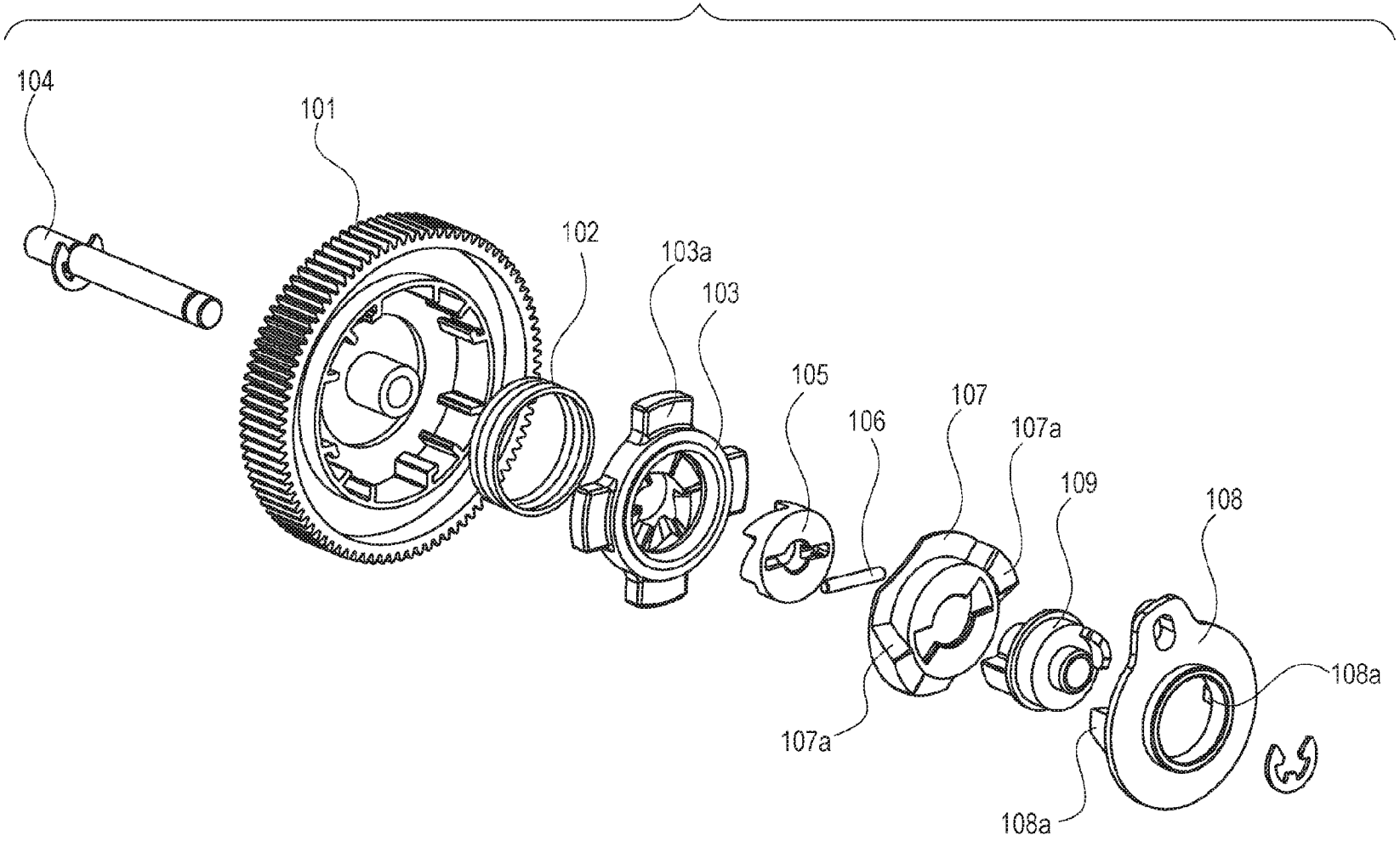
FIG. 14 is a perspective view for explaining a configuration of a clutch mechanism.
Figure 15:
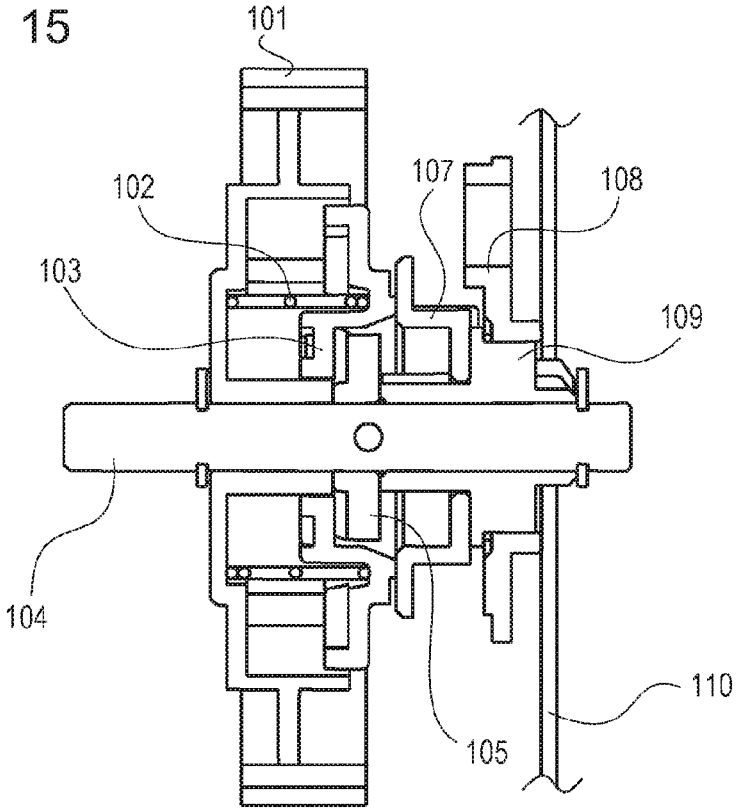
FIG. 15 is a cross-sectional view for explaining an engaged state of the clutch mechanism.
Figure 16:
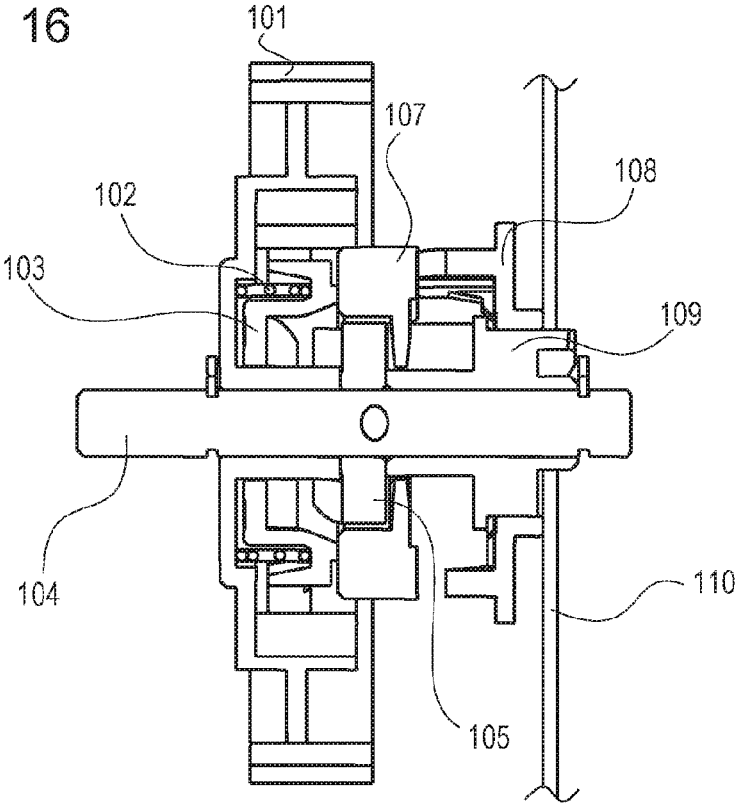
FIG. 16 is a cross-sectional view for explaining a disengaged state of the clutch mechanism.

FIG. 13 is a diagram illustrating one example of the primary transfer separation unit in the present exemplary embodiment and illustrates a cross-sectional surface of the photosensitive drums 2 in the shaft direction. The primary transfer separation unit is mainly formed of a cam 63 and a sliding member 62, and one pair of the cam 63 and the sliding member 62 is provided at each end of a shaft direction of the primary transfer rollers 59*a*, 59*b*, and 59*c*.

When the cam 63 rotates to move the sliding member 62 horizontally (in the direction of arrow), positions at which the primary transfer rollers 59*a*, 59*b*, and 59*c* are in contact or separated with or from the respective photosensitive drums 2 are able to be controlled. A driving force of the cam 63 is transmitted from the apparatus main body of the image forming apparatus 50. As described above, since the intermediate transfer unit 56 is detachably attachable, the couplings 20 and 21 illustrated in FIG. 3 are used in a driving connection portion. The driving coupling 20 is provided on the apparatus main body side and the driven coupling 21 is provided on the intermediate transfer unit 56 side. Further, for controlling the cam 63 to rotate or stop, the clutch mechanism illustrated in FIG. 6, FIG. 7, FIG. 8, FIG. 9, and FIG. 10 is provided in the apparatus main body in a driving shaft of the cam 63. Operations of the couplings 20 and 21 and the clutch mechanism used for detachably attaching the intermediate transfer unit 56 are the same as the operations described in the exemplary embodiment 1. The configurations of the couplings 20 and 21 and the clutch mechanism are also the same as the configurations described in the exemplary embodiment 1, so that detailed description thereof will be omitted here.

As described above, in the present exemplary embodiment as well, in both of a state where a driving force is released and a state where the driving force is transmitted, movement of the output shaft in the shaft direction is allowed, so that the couplings are able to be moved in the shaft direction by an attaching/detaching operation of the intermediate transfer unit. Thereby, the intermediate transfer unit is detachably attachable to the apparatus main body regardless of the engaged and disengaged states of the clutch mechanism.

Other Exemplary Embodiment

In the exemplary embodiments described above, the process cartridge and the intermediate transfer unit are exemplified as the unit detachably attachable to the main body of the image forming apparatus. However, the unit is not limited thereto as long as a unit is detachably attachable to the apparatus main body and operates upon transmission of a driving force from the apparatus main body side. A similar effect is expectable by applying the invention to the image forming apparatus to which the unit is detachably attachable. Further, the process cartridge integrally including the charging unit, the developing unit and the cleaning unit, which serve as the process unit acting on the photosensitive drums, is exemplified as the process cartridge serving as the attachable/detachable unit. However, the process cartridge is not limited thereto. A process cartridge integrally including, in addition to the photosensitive drums, any one of the charging unit, the developing unit and the cleaning unit may be used.

A printer is exemplified as the image forming apparatus in the exemplary embodiments described above, but the invention is not limited thereto. For example, other image forming apparatuses such as a copying machine, a facsimile machine, or a multifunction apparatus having functions thereof in combination may be used. By applying the invention to the driving force transmitting apparatus which transmits a driving force to a unit in an image forming apparatus to which the unit is detachably attachable, it is possible to obtain a similar effect. The image forming apparatus to which a unit having a belt (intermediate transfer body) carrying images to be transferred onto a sheet is detachably attachable is exemplified in the exemplary embodiments described above. However, the image forming apparatus is not limited thereto, and may be an image forming apparatus to which a unit having a conveying belt carrying and conveying a sheet is detachably attachable. By applying the invention to the driving force transmitting apparatus which transmits a driving force to the unit in the image forming apparatus, it is possible to obtain a similar effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-057119, filed on Mar. 20, 2015, and Japanese Patent Application No. 2016-021448, filed on Feb. 8, 2016 which are hereby incorporated by reference herein in their entirety.

What is claimed is:

1. A driving force transmitting apparatus which is engaged with a unit detachable and attachable to a main body of an image forming apparatus and transmits or cuts off a driving force to the unit, comprising:

an output member which includes a coupling allowed to be engaged with the unit and which is engaged with the unit to transmit the driving force;

an input member which is rotated by the driving force;

an input-side engagement member which is provided so as to be movable with respect to the output member in a rotational axis direction of the output member and rotates integrally with the input member;

an output-side engagement member which is allowed to be engaged with the input-side engagement member, the output-side engagement member rotating integrally and moving integrally in the rotational axis direction with the output member;

an elastic member which is provided between the input member and the input-side engagement member and having urging forces that urge the input-side engagement member toward the output-side engagement member; and a disengagement member which moves the input-side engagement member at an engaged position, at which engagement with the output-side engagement member is allowed, in the rotational axis direction against an urging force of the elastic member to move the input-side engagement member to a disengaged position at which engagement with the output-side engagement member is released and cut off transmission of the driving force to the unit, wherein in an engagement state where the input-side engagement member is at the engaged position, the driving force is transmitted from the input member to the output member through the input-side engagement member and the output-side engagement member, wherein in each of the engagement state and a disengagement state where the input-side engagement member is at the disengaged position, the output member is allowed to move in a first direction which is parallel to the rotational axis direction and closer to the input-side engagement member when the output member is pressed by the unit, and wherein in each of the engagement state and the disengagement state, when the output member is moved in the first direction, the output-side engagement member moves in a second direction which is parallel to the rotational axis direction and away from the input-side engagement member.

2. The driving force transmitting apparatus according to claim 1, wherein in each of the engagement state and the disengagement state, the input member is allowed to move in the rotational axis direction when the output member is moved in the first direction.

3. The driving force transmitting apparatus according to claim 1, wherein in each of the engagement state and the disengagement state, when the output member is pressed by the unit to the rotational axis direction, the input member is pressed by the output member and moves in the rotational axis direction against the urging force of the elastic member.

4. The driving force transmitting apparatus according to claim 1, further comprising a frame member situated on the main body of the image forming apparatus and a bearing member which is provided on the frame and supports the output member to be rotatable and movable in the rotational axis direction with respect to the frame member, wherein a space for allowing the output-side engagement member to move in the second direction is provided between the output-side engagement member and the bearing member.

5. The driving force transmitting apparatus according to claim 1, wherein the elastic member is a compression spring.

6. The driving force transmitting apparatus according to claim 1, wherein the coupling included in the output member has an inclined surface or a curved surface at a front edge engaged with the unit.

7. The driving force transmitting apparatus according to claim 6, wherein the coupling included in the output member has a convex shape at the front edge engaged with the unit.

8. The driving force transmitting apparatus according to claim 6, wherein the coupling included in the output member has a concave shape at the front edge engaged with the unit.

9. An image forming apparatus forming an image on a sheet and including a driving force transmitting apparatus which is engaged with a unit detachable and attachable to a main body of the image forming apparatus and transmits or cuts off a driving force to the unit, the driving force transmitting apparatus comprising:

an output member which includes a coupling allowed to be engaged with the unit and which is engaged with the unit to transmit the driving force;

an input member;

an input-side engagement member which is provided so as to be movable with respect to the output member in a rotational axis direction of the output member and rotates integrally with the input member;

an output-side engagement member which is allowed to be engaged with the input-side engagement member, the output-side engagement member rotating integrally and moving integrally in the rotational axis direction with the output member;

an elastic member which is provided between the input member and the input-side engagement member and having urging forces that urge the input-side engagement member toward the output-side engagement member; and a disengagement member which moves the input-side engagement member at an engaged position, at which engagement with the output-side engagement member is allowed, in the rotational axis direction against an urging force of the elastic member to move the input-side engagement member to a disengaged position at which engagement with the output-side engagement member is released and cut off transmission of the driving force to the unit, wherein in an engagement state where the input-side engagement member is at the engaged position, the driving force is transmitted from the input member to the output member through the input-side engagement member and the output-side engagement member, wherein in each of the engagement state and a disengagement state where the input-side engagement member is at the disengaged position, the output member is allowed to move in a first direction which is parallel to the rotational axis direction and closer to the input-side engagement member when the output member is pressed by the unit, and wherein in each of the engagement state and the disengagement state, when the output member is moved in the first direction, the output-side engagement member moves in a second direction which is parallel to the rotational axis direction and away from the input-side engagement member.

10. The image forming apparatus according to claim 9, wherein in each of the engagement state and the disengagement state, a space is formed in which the input member is allowed to move in the rotational axis direction when the output member is pressed by the unit to the rotational axis direction.

11. The image forming apparatus according to claim 9, wherein in each of the engagement state and the disengagement state, when the output member is pressed by the unit to the rotational axis direction, the input member is pressed by the output member and moves in the rotational axis direction against the urging force of the elastic member.

12. The image forming apparatus according to claim 9, wherein the driving force transmitting apparatus further includes a frame member situated on the main body of the image forming apparatus and a bearing member which is provided on the frame and supports the output member to be rotatable and movable in the rotational axis direction with respect to the frame member, and a space for allowing the output-side engagement member to move in the second direction is provided between the output-side engagement member and the bearing member.

13. The image forming apparatus according to claim 9, wherein the elastic member is a compression spring.

14. The image forming apparatus according to claim 9, wherein the coupling included in the output member has an inclined surface or a curved surface at a front edge engaged with the unit.

15. The image forming apparatus according to claim 14, wherein the coupling included in the output member has a convex shape at the front edge engaged with the unit.

16. The image forming apparatus according to claim 14, wherein the coupling included in the output member has a concave shape at the front edge engaged with the unit.

17. The image forming apparatus according to claim 9, wherein the unit is a process cartridge having an image bearing member and a process unit acting on the image bearing member.

18. The image forming apparatus according to claim 9, wherein the unit is a unit having a belt which bears a sheet or an image to be transferred onto the sheet.

* * * * *